US005941419A

United States Patent [19]

Molinary

[11] Patent Number: 5,941,419

[45] Date of Patent: Aug. 24, 1999

[54] SPRAY CAN PAINT DISPENSING SYSTEM

[76] Inventor: Adolf Molinary, 14260 NE. 12 Ave., NE Miami, Fla. 33161

[21] Appl. No.: 09/065,718

[22] Filed: Apr. 24, 1998

[51] Int. Cl.[6] ..... B67D 5/00

[52] U.S. Cl. ..... 222/82; 222/83.5

[58] Field of Search ..... 222/82, 83, 83.5, 222/5

[56] References Cited

U.S. PATENT DOCUMENTS

| | | | |
|---|---|---|---|
| 2,260,875 | 10/1941 | Vranichar | 222/83.5 |
| 2,581,324 | 1/1952 | Hartzell | 222/83 |
| 3,333,735 | 8/1967 | Odasso | 222/82 |
| 5,271,437 | 12/1993 | O'Brien et al. | 222/83.5 |
| 5,630,529 | 5/1997 | Chlupp | 222/83.5 |

*Primary Examiner*—Philippe Derakshani

[57] ABSTRACT

A spray can paint dispensing system comprising, in combination a support assembly for a paint spray can with a clogged nozzle comprising an support and a lower support with a floor for the base of a spray can with a first bearing aperture and a second bearing aperture, a piercing assembly comprising a fixed component with a radially disposed bore secured, the piercing assembly also comprising a component with a therethrough, the component including an exterior segment and an interior segment reciprocal within the bore of the component to penetrate a spray can in the support assembly for releasing paint therein and dispersing it through the passageway.

3 Claims, 3 Drawing Sheets

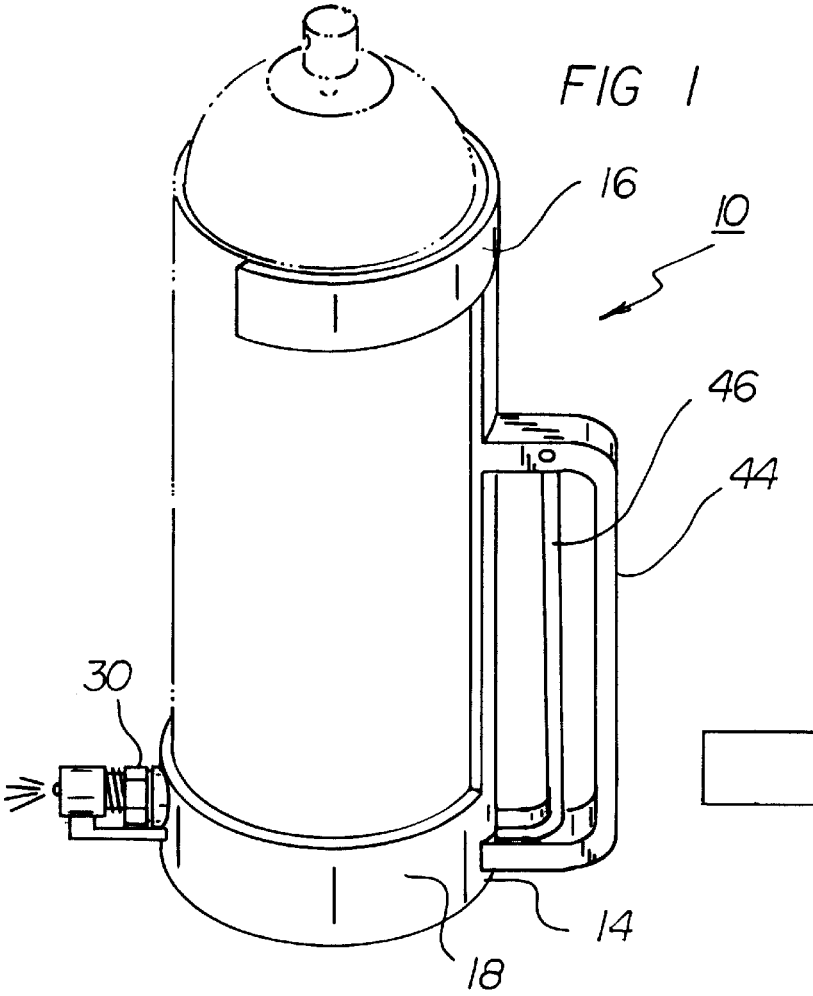
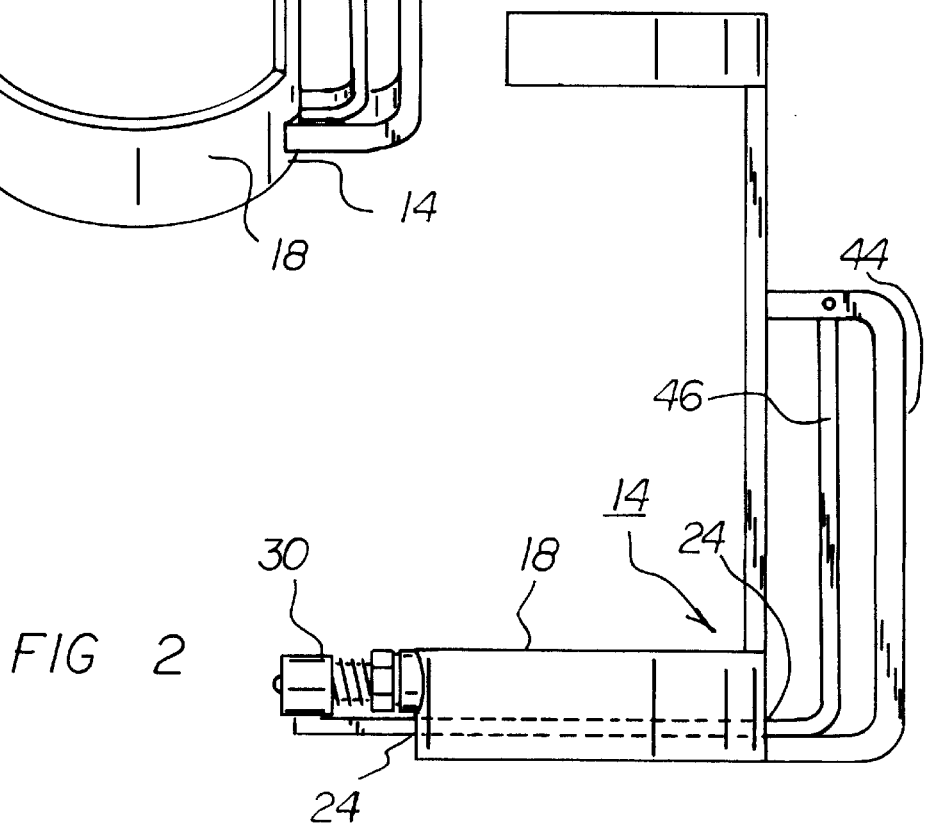
FIG 2

FIG 5
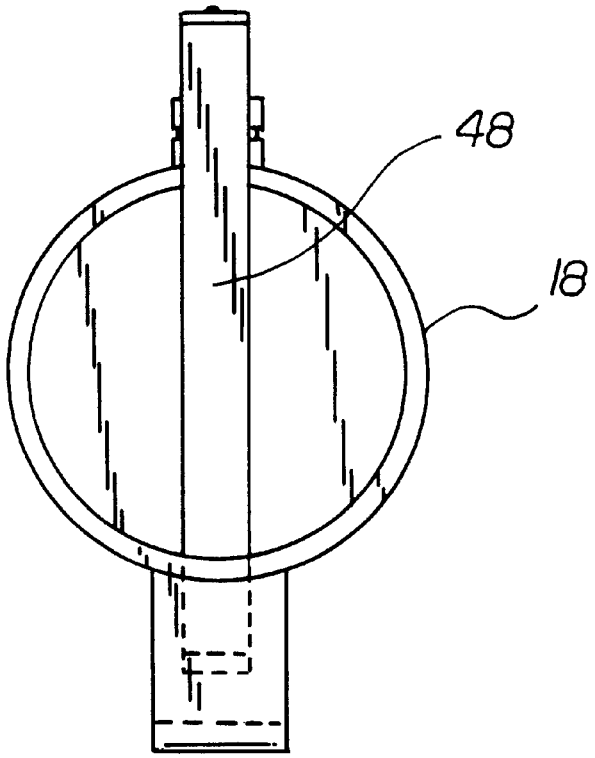
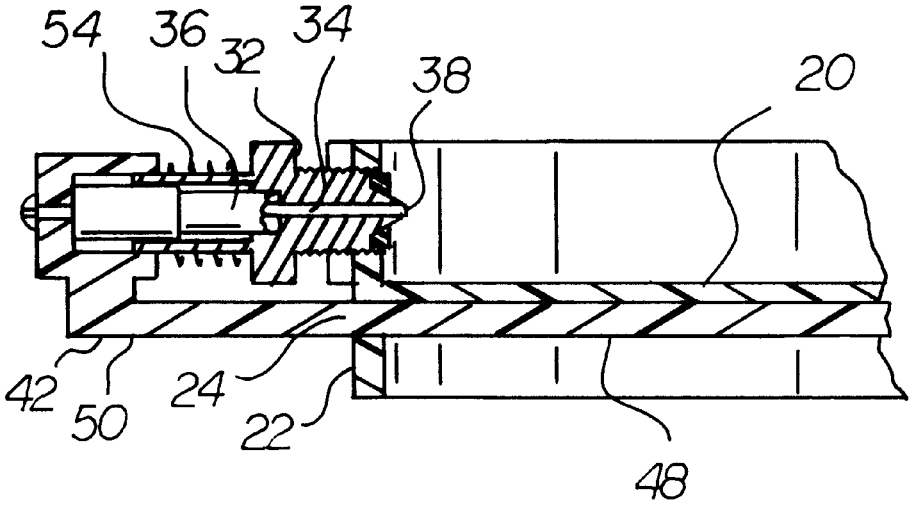
FIG 6

SPRAY CAN PAINT DISPENSING SYSTEM

BACKGROUND OF THE INVENTION

1. Field of the Invention

The present invention relates to a spray can paint dispensing system and more particularly pertains to dispensing paint from a spray can with a clogged nozzle.

2. Description of the Prior Art

The use of apparatus for dispensing liquid contents from spray cans of various designs and configurations is known in the prior art. More specifically, apparatus for dispensing liquid contents from spray cans of various designs and configurations heretofore devised and utilized for the purpose of ensuring the dispensing of contents from canisters through various methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,323,937 to Brody discloses a Spray Can Actuation Device With Improved Can Retention. U.S. Pat. No. 4,805,812 to Brody discloses a Spray Can Actuation Device With Locking Mechanism. U.S. Pat. No. 4,432,474 to Hutchinson et al. discloses a Handle and Actuating Device for Pressurized Dispensers. U.S. Pat. No. 3,977,570 to Smart discloses a Spraying Apparatus. Lastly, U.S. Pat. No. 4,092,000 to Offutt, Ill., discloses an Extension Spray Device. U.S. Pat. Des. No. 350,287 to Kobayashi et al. discloses a Spray Nozzle Attachment For A Pressurized Aerosol Can.

In this respect, the spray can paint dispensing system according to the present invention substantially departs from the conventional concepts and designs of the prior art, and in doing so provides an apparatus primarily developed for the purpose of dispensing paint from a spray can with a clogged nozzle.

Therefore, it can be appreciated that there exists a continuing need for a new and improved spray can paint dispensing system which can be used for dispensing paint from a spray can with a clogged nozzle. In this regard, the present invention substantially fulfills this need.

SUMMARY OF THE INVENTION

In view of the foregoing disadvantages inherent in the known types of apparatus for dispensing liquid contents from spray cans of various designs and configurations now present in the prior art, the present invention provides an improved spray can paint dispensing system. As such, the general purpose of the present invention, which will be described subsequently in greater detail, is to provide a new and improved spray can paint dispensing system and method which has all the advantages of the prior art and none of the disadvantages.

To attain this, the present invention essentially comprises a spray can paint dispensing system for dispensing paint from a spray can with a clogged nozzle comprising, in combination a support assembly having a circular upper support and a cylindrical lower support with a floor for the base of a spray can. The lower support having a generally cylindrical side wall. The cylindrical side wall having a lower cylindrical plate beneath the floor with a first bearing aperture and a diametrically opposed second bearing aperture. A piercing assembly is provided comprising a fixed component with a radially disposed bore secured within the cylindrical side wall above the second aperture. The piercing assembly also comprising an axially reciprocal component with a radially disposed passageway therethrough. The reciprocal component including an exterior segment and an interior segment reciprocal within the bore of the fixed component to penetrate a spray can in the support assembly for releasing paint therein and dispersing it through the passageway. An actuating assembly comprising a post coupling the upper and lower support with a handle coupled with respect thereto. The actuating assembly also including a trigger having an upper end pivotally coupled with respect to the handle and an intermediate extent extending through the bearing apertures of the support and a lower extent positioned in operative association with the piercing assembly adapted to push the reciprocal component of the piercing assembly toward and into the can upon squeezing of the trigger. The lower extent and aperture in alignment with the passageway of the piercing assembly for constituting a spray nozzle. A coil spring is provided and is operatively located between the fixed component of the piercing assembly and the reciprocal component of the piercing assembly to withdraw the reciprocal component from the spray can upon release of the trigger.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved spray can paint dispensing system which has all of the advantages of the prior art apparatus for dispensing liquid contents from spray cans of various designs and configurations and none of the disadvantages.

It is another object of the present invention to provide a new and improved spray can paint dispensing system which may be easily and efficiently manufactured and marketed.

It is further object of the present invention to provide a new and improved spray can paint dispensing system which is of durable and reliable constructions.

An even further object of the present invention is to provide a new and improved spray can paint dispensing system which is susceptible of a low cost of manufacture with regard to both materials and labor, and which accordingly is then susceptible of low prices of sale to the consuming public, thereby making such spray can paint dispensing system economically available to the buying public.

Even still another object of the present invention is to provide a spray can paint dispensing system for dispensing paint from a spray can with a clogged nozzle.

Lastly, it is an object of the present invention to provide a new and improved spray can paint dispensing system comprising, in combination a support assembly for a paint spray can with a clogged nozzle comprising an support and a lower support with a floor for the base of a spray can with a first bearing aperture and a second bearing aperture, a piercing assembly comprising a fixed component with a radially disposed bore secured, the piercing assembly also comprising a component with a therethrough, the component including an exterior segment and an interior segment reciprocal within the bore of the component to penetrate a spray can in the support assembly for releasing paint therein and dispersing it through the passageway.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the spray can paint dispensing system constructed in accordance with the principles of the present invention.

FIG. 2 is a side elevational view of the system shown in FIG. 1 but with the spray can removed.

FIG. 5 is a bottom elevational view taken along line 5—5 of FIG. 4.

FIG. 6 is a cross-sectional view taken along line 6—6 of FIG. 4.

The same reference numerals refer to the same parts through the various Figures.

DESCRIPTION OF THE PREFERRED EMBODIMENT

Figure 3:
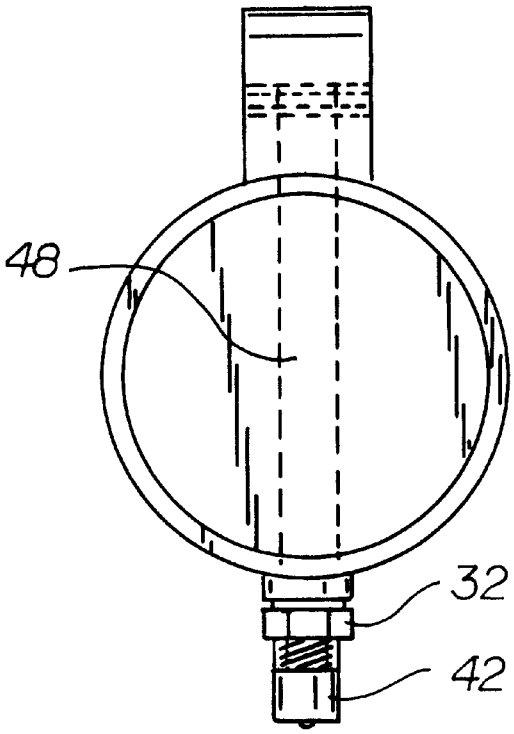
FIG. 3 is a top elevational view of the assembly shown in FIG. 2.
Figure 4:
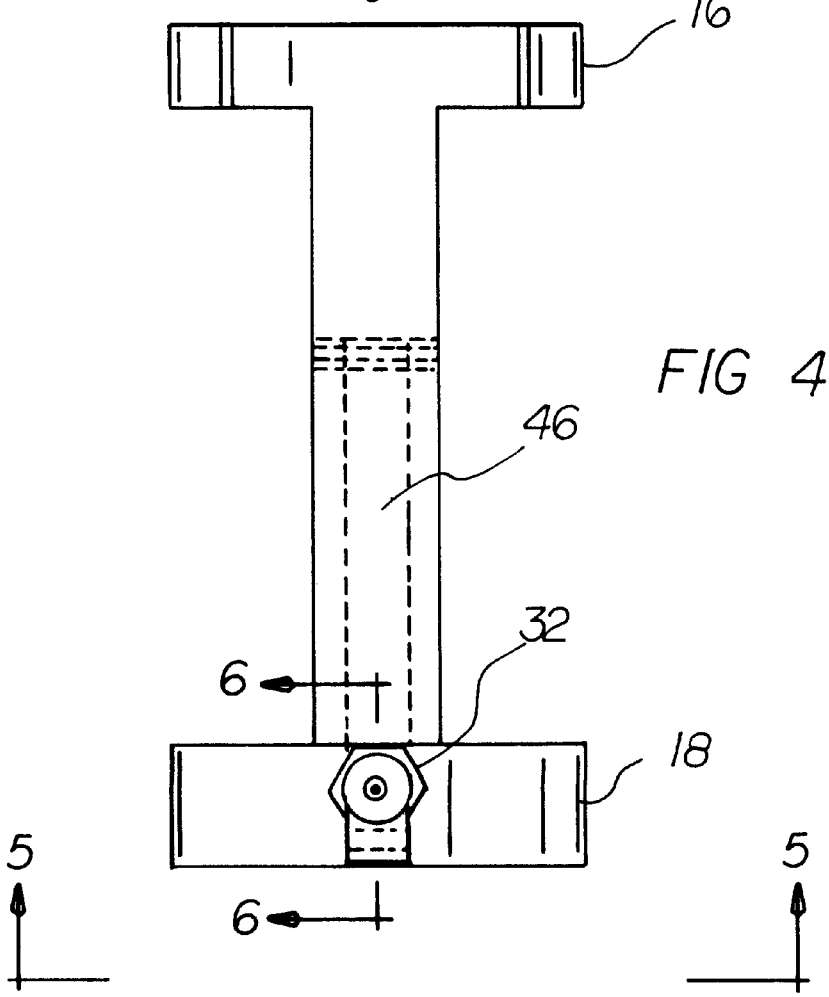
FIG. 4 is a front elevational view of the system shown in the prior Figures.

With reference now to the drawings, and in particular to FIG. 1 thereof, the preferred embodiment of the new and improved spray can paint dispensing system embodying the principles and concepts of the present invention and generally designated by the reference numeral 10 will be described.

The present invention, the spray can paint dispensing system 10 is comprised of a plurality of components. Such components are individually configured and correlated with respect to each other so as to attain the desired objective.

More specifically, the present invention comprises in combination a support assembly 14 having a circular upper support 16 and a cylindrical lower support 18 with a floor 20 for the base of a spray can. The lower support 18 having a generally cylindrical side wall 20. The cylindrical side wall 20 having a lower cylindrical plate 22 beneath the floor with a first bearing aperture 24 and a diametrically opposed second bearing aperture 26.

A piercing assembly 30 is provided comprising a fixed component with a radially disposed bore secured within the cylindrical side wall above the second aperture. The piercing assembly also comprising an axially reciprocal component 32 with a radially disposed passageway 34 therethrough. The reciprocal component 32 including an exterior segment 36 and an interior segment 38 reciprocal within the bore of the fixed component to penetrate a spray can in the support assembly for releasing paint therein and dispersing it through the passageway.

An actuating assembly 42 is provided comprising a post coupling the upper and lower support with a handle 44 coupled with respect thereto. The actuating assembly 42 also including a trigger 46 having an upper end pivotally coupled with respect to the handle 44 and an intermediate extent 48 extending through the bearing apertures of the support and a lower extent 50 positioned in operative association with the piercing assembly adapted to push the reciprocal component of the piercing assembly toward and into the can upon squeezing of the trigger. The lower extent and aperture in alignment with the passageway of the piercing assembly for constituting a spray nozzle.

A coil spring 54 is provided and is operatively located between the fixed component of the piercing assembly and the reciprocal component of the piercing assembly to withdraw the reciprocal component from the spray can upon release of the trigger.

The present system as hereinabove described comprises a spray can attachment that features a hose and spray nozzle and would be adapted to a standard spray can. When the nozzle on a can clogs, the user could simply snap this product onto the can, and the spray nozzle would be positioned at the bottom of the can. The present system would allow the unused portion of liquid inside a spray can to be completely dispensed.

The appealing features of the present system would be its convenience, durability, timesaving capability, cost-savings, effectiveness, and ease of use. The system would allow the entire contents of a spray can to be dispensed with ease and minimal effort. The system would provide an optional spray nozzle that could be used when the original nozzle would be clogged. With this attachment, the entire contents of the can could be used, which would prevent premature replacement purchases, as well as waste of the liquid product. This product would be convenient and easy to use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved spray can paint dispensing system for dispensing paint from a spray can with a clogged nozzle comprising, in combination:

a support assembly for a paint spray can with a clogged nozzle comprising a circular upper support and a cylindrical lower support with a floor for the base of a spray can, the lower support having a generally cylindrical side wall, the cylindrical side wall having a lower cylindrical plate beneath the floor with a first bearing aperture and a diametrically opposed second bearing aperture;

a piercing assembly comprising a fixed component with a radially disposed bore secured within the cylindrical side wall above the second aperture, the piercing assembly also comprising an axially reciprocal component with a radially disposed passageway therethrough, the reciprocal component including an exterior segment and an interior segment reciprocal within the bore of the fixed component to penetrate a spray can in the support assembly for releasing paint therein and dispersing it through the passageway;

an actuating assembly comprising a post coupling the upper and lower support with a handle coupled with respect thereto, the actuating assembly also including a trigger having an upper end pivotally coupled with respect to the handle and an intermediate extent extending through the bearing apertures of the support and a lower extent positioned in operative association with the piercing assembly adapted to push the reciprocal component of the piercing assembly toward and into the can upon squeezing of the trigger, the lower extent an aperture in alignment with the passageway of the piercing assembly for constituting a spray nozzle;

a coil spring operatively located between the fixed component of the piercing assembly and the reciprocal component of the piercing assembly to withdraw the reciprocal component from the spray can upon release of the trigger.

2. A spray can paint dispensing system comprising, in combination:

a support assembly for a paint spray can with a clogged nozzle comprising an upper support and a lower support with a floor for the base of a spray can with a first bearing aperture and a second bearing aperture;

a piercing assembly comprising a fixed component with a radially disposed bore, the piercing assembly also comprising a component with a passageway therethrough, the component including an exterior segment and an interior segment reciprocal within the bore of the component to penetrate a spray can in the support assembly for releasing paint therein and dispersing it through the passageway; and an actuating assembly comprising a post coupling the upper and lower support with a handle coupled with respect thereto, the actuating assembly also including a trigger having an upper end pivotally coupled with respect to the handle and an intermediate extent extending through the bearing apertures of the support and a lower extent positioned in operative association with the piercing assembly adapted to push the reciprocal component of the piercing assembly toward and into the can upon squeezing of the trigger, the lower extent an aperture in alignment with the passageway of the piercing assembly for constituting a spray nozzle.

3. The spray can dispensing system as claimed in claim 2 further including a coil spring operatively located between the fixed component of the piercing assembly and the reciprocal component of the piercing assembly to withdraw the reciprocal component from the spray can upon release of the trigger.

* * * * *